United States Patent [19]

Smith et al.

[11] Patent Number: 4,958,427

[45] Date of Patent: Sep. 25, 1990

[54] TELEPHONE WIRE TERMINATION BLADE STORAGE COMPARTMENT

[75] Inventors: Terry L. Smith, Westlake Village; William D. Krietzman, Lancaster, both of Calif.

[73] Assignee: Harris Corporation, Melbourne, Fla.

[21] Appl. No.: 224,382

[22] Filed: Jul. 26, 1988

[51] Int. Cl.[5] ..... H01R 43/00

[52] U.S. Cl. ..... 27/566.4; 7/107; 7/167; 29/751; 29/758; 30/125; 30/339

[58] Field of Search ..... 29/566.4, 751, 758; 7/107, 167; 30/125, 337, 338, 339

[56] References Cited

U.S. PATENT DOCUMENTS

| | | | |
|---|---|---|---|
| 237,093 | 2/1881 | Crowell | 30/329 |
| 1,298,961 | 4/1919 | Kelly | 30/125 X |
| 2,629,413 | 2/1953 | Stettler | 7/167 X |
| 2,683,931 | 7/1954 | Fahlgren | 30/125 X |
| 3,410,457 | 11/1968 | Brown | 30/125 X |
| 4,194,256 | 3/1980 | Knickerbocker | 29/758 X |
| 4,241,496 | 12/1980 | Gregson | 29/758 X |

*Primary Examiner*—Carl E. Hall

*Attorney, Agent, or Firm*—Evenson, Wands, Edwards, Lenahan & McKeown

[57] ABSTRACT

A telephone wire connector blade storage device, for use with an impact force insertion tool, comprises a generally rectangular shaped housing, the interior of which is divided into a plurality of blade storage bins which extend longitudinally through and are accessible by way of an end cap at one end of the housing. Protruding from the opposite end of the housing is a stem that is sized and shaped to be engageable with a bore in the rear end of the insertion tool, so as to enable the storage device to be fixedly attached to the handle at a location that does not interfere with the operation of the tool. In addition, the shape of the rectangular housing approximates that of the rear end of the tool handle, so as to facilitate manipulation of the handle by the craftsperson during use of the tool. Preferably, the end of the rectangular housing, from which the engagement stem protrudes, has a concave setback portion, allowing the outer wall of the housing to fit snugly around the rear end surface of the tool handle and assist in maintaining alignment of the storage device with the handle. As an additional feature, the outer wall of the housing is provided with a belt mounting spring type clip that serves to rotationally secure an end cap to the housing.

16 Claims, 3 Drawing Sheets

TELEPHONE WIRE TERMINATION BLADE STORAGE COMPARTMENT

FIELD OF THE INVENTION

The present invention relates in general to electrical connector (blade) insertion tools for use with telephone wire termination blocks and is particularly directed to a termination blade storage compartment that may be directly coupled with such a tool for storing a plurality of blades for use thereby.

BACKGROUND OF THE INVENTION

Hand held impact tools are used by telephone craftspersons for the termination of blade-captured wires into terminal blocks of telephone equipment installations. One particularly useful impact tool which can be used for a variety of blades including Western Electric designation type "66" or type "88" termination blades is described in the U.S. Pat. No. 4,241,496 to D. L. Gregson, issued Dec. 30, 1980, currently assigned to the assignee of the present application and the disclosure of which is incorporated herein by reference. In accordance with the configuration and operation of this patented tool design, one end of an internal bore of the tool handle is arranged to hold either of the "66" or "88" type blades and impart thereto a selectable high or low impact force necessary to drive the blade into the termination block. The other end of the handle's internal bore is provided with a storage pouch having an adjustable spring which permits an individual one of either type of blade to be accepted and releasably retained in the storage pouch. Now, although the patented tool configuration offers improved versatility and compactness with respect to previously proposed insertion tool designs, it's blade storage pouch can accommodate only a single blade, thereby requiring the craftsperson to carry additional blades (of both types) in a separate container or containers, which are not always immediately and easily accessible.

SUMMARY OF THE INVENTION

In accordance with the present invention the single blade capacity of the internal storage pouch of the above-identified patented impact tool is augmented by a blade storage device that is capable of storing a plurality of blades in a compact, compartmentalized configuration that may be readily engaged with the handle of the insertion tool, so as to facilitate access to the blades during operation of the tool by the craftsperson. To this end, the storage device of the present invention comprises a generally rectangular shaped housing, the interior of which is divided into a plurality of blade storage bins which extend longitudinally through and are accessible from a door, or cap, at one end of the housing. Protruding from the opposite end of the housing is a stem or insert that is sized and shaped to be engageable with the bore in the rear end of the patented insertion tool, so as to enable the storage device to be fixedly attached to the handle at a location that does not interfere with the operation of the tool. In addition, the shape of the rectangular housing approximates that of the rear end of the tool handle, so as to facilitate manipulation of the handle by the craftsperson during use of the tool. Preferably, the end of the rectangular housing, from which the engagement stem protrudes, has a concave setback portion, allowing the outer wall of the housing to fit snugly around the rear end surface of the tool handle and assist in maintaining alignment of the storage device with the handle. As an additional feature, the outer wall of the housing may be provided with a spring type clip to permit the device to be worn by the craftsperson (as by clip attachment to the craftsperson's utility belt).

In accordance with a preferred embodiment, the housing is comprised of a solid section of rectangular shaped plastic material having a central bore and a plurality of blade storage compartment radially distributed around the central bore, each of which is parallel to the longitudinal axis of the housing. The central bore extends completely through the housing, opening at one end adjacent to the concave setback portion to allow a tool engagement pin that has been inserted into the bore from the opposite end to join the storage device to the tool. At the opposite end of the device a cap, for closing access to the bores of the housing, is provided. The cap preferably includes a lip portion at one side thereof for engaging a detent in the housing and a rotation bar that is arranged to be rotationally held by a spring clip retainer provided in the outer wall of the rectangular shaped housing.

DETAILED DESCRIPTION

Figure 1:
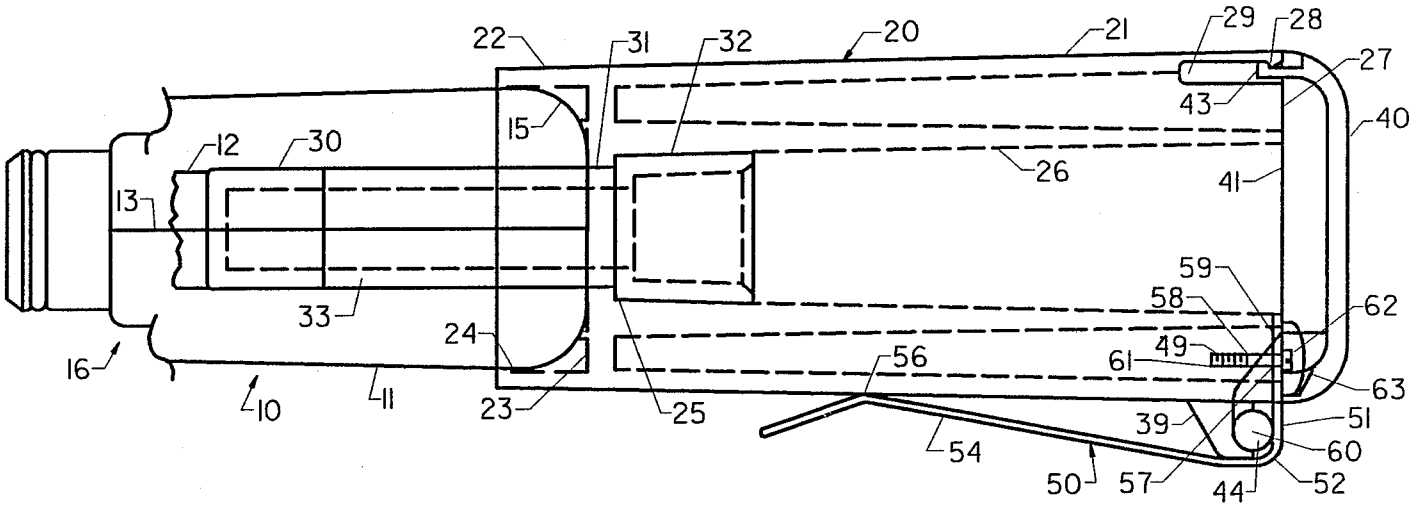
FIG. 1 diagrammatically shows a side view of a blade storage device in accordance with the present invention.

Referring to FIG. 1 of the drawings, there is diagrammatically shown a side view of a blade storage device in accordance with the present invention, engaging the handle of the selectable force impact termination tool disclosed in the above-referenced '496 Patent. Specifically, FIG. 1 shows a simplified illustration of the impact termination tool 10 having a handle 11 that contains an internal cylindrical bore 12, coaxial with the central longitudinal axis 13 of the tool, which extends to a rear or end surface 14 of the handle, a contoured or curved portion of which is shown at 15. The slide assembly at the front or forward end of the tool is shown in a reduced form at 16 in order to simplify the drawing. As noted previously, the disclosure of the above-referenced '496 Patent is incorporated herein by reference and attention may be directed to the Patent for further details of the tool that are not described here.

As noted previously and described in the above-referenced Patent, handle 11 includes an internal axial bore 12 that is normally employed for defining a storage pouch for releasably receiving and retaining an individual termination blade (not shown). In accordance with the present invention, rather than store a single blade, bore 12 receives and captures a multiple blade storage device 20 by means of a coupling pin 30 that is sized to snugly fit within bore 12 and is locked in place by a manually operable coiled spring (not illustrated) within the bore. In particular, storage device 20 is comprised of a generally rectangular-cylindrically shaped housing 21, the longitudinal axis of which is coaxial with axis 13 of handle 11, and a first end of which has a concave setback portion 22, formed of a seat-defining endwall 23 and sidewall 24, that is sized to receive and abut against the end surface 14 and contoured rear surface 15 of handle 11. Endwall 23 has a circular aperture 31, coaxial with axis 13, for accommodating the cylindrical shank 33 of pin 30, the enlarged diameter head 32 of which abuts against an interior surface region 25 of endwall 23 and the outer diameter of which is sized to snugly fit within (be frictionally engaged by) the interior cylindrical surface of a central blade storage bore 26, that is coaxial with axis 13 and extends to a second end 27 of housing 21.

Figure 2:
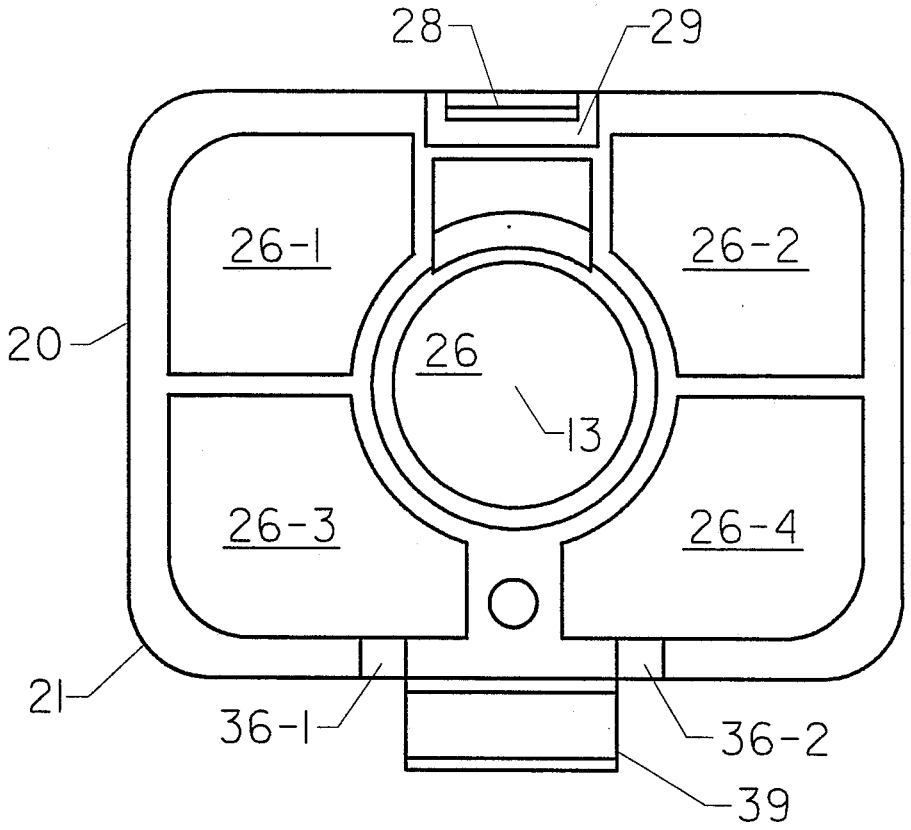
FIG. 2 is an end view of the blade storage device shown in FIG. 1.

As shown in the device end view of FIG. 2, in addition to central bore 26, housing 21 is also provided with a plurality of blade-storage bins 26-1, 26-2, 26-3 and 26-4 that extend in parallel with axis 13 to interior surface 25 of endwall 23 and are distributed radially around central bore 26. Each of central bore 26 and radially distributed storage bins 26-1 . . . 26-4 is sized to accommodate the storage of a plurality of termination blades. To releasably secure the contents of the storage bores, the end surface 25 of housing 21 is closed off by way of a door, or cap, 40, shown in detail in FIGS. 3 and 4.

More particularly, cap 40 has a flat bottom surface 41, from one side of which extends a lip 43, that is shaped to engage a detent 28 of a slot 29 at one side of housing 21. An opposite side of housing 21 is provided with a pair of spaced-apart, generally rectangularly shaped cutout portions 36-1 and 36-2, that are sized and shaped to receive a pair of cylindrical segments 43-1 and 43-2, respectively, of a rotation bar 44 that extends from the bottom surface 41 of cap 40, at a side portion thereof opposite the side from which lip 43 extends, and abuts against a trough-like lip portion 39 of housing 21.

Figure 3:
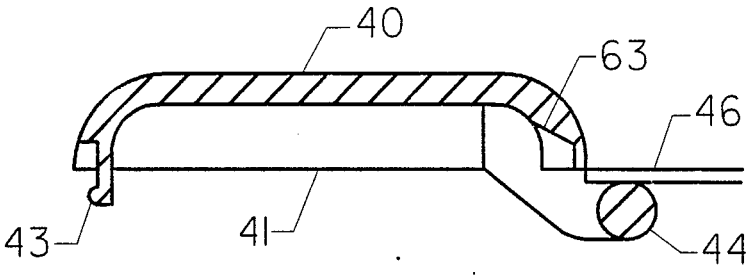
FIGS. 3 and 4 are respective side sectional and top views of an end cap for the blade storage device of FIG. 1.
Figure 4:
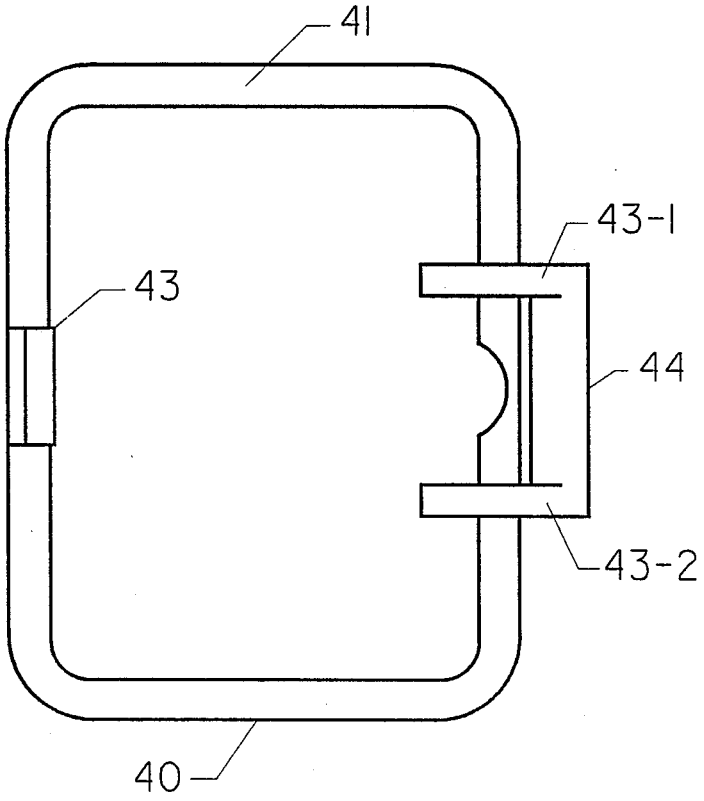

As shown in FIG. 3, a small clearance region 46 is provided between rotation bar 44 and the bottom surface 41 of cap 40. This clearance region is sized to accommodate the thickness of a top flat portion 51 of a generally L-shaped spring or band-type belt clip 50, a curved or radially bent portion 52 of which is sized to effectively wrap around the surface of rotation bar 44 as shown in FIG. 1. From radially curved portion 52 a longitudinal portion 54 of spring clip 50 is urged against the outer surface of housing 21 at a bent portion 56, as shown, so as to facilitate attachment to a craftsperson's utility belt.

The top flat portion 51 of clip 50 is provided with a hole 57 for receiving the shank of a screw 58 that is used to attach clip 50 to a recessed portion 59 of end surface 26 of housing 21, as the screw is secured into a bore 61. To accommodate the head 62 of screw 58 the bottom surface 41 of cap 40 is provided with an indented region 63. Attachment of the clip 50 by way of screw 58 also serves to rotationally secure cap 40 to housing 21. Specifically, with the radially bent portion of clip 50 wrapped around rotation bar 44, segments 43-1 and 43-2 of rotation bar 44 are rotationally captured within slots 36-1 and 36-2, respectively, as bar 44 abuts against lip portion 39, thereby providing a pivotal attachment location of cap 40 to housing 21 and facilitating access to the blade storage bores of the housing.

As will be appreciated from the foregoing description, the single blade storage capacity of the above-identified patented impact tool may be significantly enhanced by the blade storage device according to the present invention, which is capable of storing a plurality of blades in a compact, compartmentalized configuration that may be readily engaged with the handle of the insertion tool, thereby facilitating access to the blades during operation of the tool by the craftsperson.

While we have shown and described an embodiment in accordance with the present invention, it is to be understood that the same is not limited thereto but is susceptible to numerous changes and modifications as known to a person skilled in the art, and we therefore do not wish to be limited to the details shown and described herein but intend to cover all such changes and modifications as are obvious to one of ordinary skill in the art.

What is claimed is:

1. For use with a blade termination tool having a handle with an accessible internal bore, a blade storage device attachable to said tool comprising:

a housing having at least one closable compartment of a size and shape for storing therein a plurality of blades upon which said tool operates; and means, coupled with said housing, for attaching said housing to said tool by way of the externally accessible internal bore of said handle, and wherein said housing contains a plurality of compartments extending in parallel with one another in the direction of the longitudinal direction of said handle, and wherein said attaching means is accessible by way of one of said compartments, and wherein said attaching means comprises a pin having a head portion engageable with said one of said compartments and a shank extending externally of said housing and being sized and of a length to be inserted in the internal bore of said handle.

2. A storage device according to claim 1, wherein said housing further includes a generally cup-shaped portion of a size and shape for snugly surrounding and abutting against an end portion of said handle.

3. A storage device according to claim 2, further including a cap rotatably attached to an end portion of said housing opposite an end thereof by way of which said housing is attached to said handle by said attaching means, said cap, in the closed position, preventing access to said plurality of storage compartments and being rotatable to enable open access thereto.

4. A storage device according to claim 3, further comprising a spring clip having a first portion thereto affixed to said housing a second portion thereof displaceably abuttable against said housing and a third portion, located between said first and second portions, engaging said cap and providing rotational movement therebetween and thereby pivotal attachment of said cap to said housing.

5. A storage device according to claim 4, wherein said cap further includes a snap fitting arranged for engagement in the closed position of said cap with an associated contoured slot in said housing provided at the cap attaching end portion of said housing.

6. An insertion tool according to claim 5, wherein said cap further includes a snap fitting arranged for engagement in the closed position of said cap with an associated contoured slot in said housing provided at the cap attaching end portion of said housing.

7. A storage device for use with a blade termination tool having a handle with an accessible internal bore, a blade storage device attachable to said tool comprising:

a housing having at least one closable compartment of a size and shape for storing therein a plurality of blades upon which said tool operates; and means, coupled with said housing, for attaching said housing to said tool by way of the externally accessible internal bore of said handle, and wherein said housing contains a plurality of compartments extending in parallel with one another in the direction of the longitudinal direction of said handle, and wherein said attaching means is accessible by way of one of said compartments, further including a cap rotatably attached to an end portion of said housing opposite an end thereof by way of which said housing is attached to said handle by said attaching means, said cap, in the closed position, preventing access to said plurality of storage compartments and being pivotable to enable open access thereto, further comprising a spring clip having a first portion thereof affixed to said housing and a second portion thereto displaceably abuttable against said housing, and wherein said spring clip further includes a third portion engaging said cap and providing rotational movement therebetween and thereby rotational attachment of said cap to said housing.

8. A storage device according to claim 7, wherein said cap further includes a snap fitting arranged for engagement in the closed position of said cap with an associated contoured slot in said housing provided at the cap attaching end portion of said housing.

9. A tool blade insertion tool having a facility for storing a plurality of tool blades insertable into a connector receptacle by the operation of said tool comprising, in combination:

an impact force-imparting mechanism at one end thereof by way of which a tool blade is forced against a receptacle by the operation of said impact force-imparting mechanism and an externally accessible bore at a second end thereof;

a housing having at least one closable compartment of a size and shape for storing therein a plurality of tool blades upon which the impact force imparting mechanism of said tool operates; and means, coupled with said housing, for attaching said housing to said tool by way of the externally accessible internal bore said handle, and wherein said housing contains a plurality of compartments extending in parallel with one another in the direction of the longitudinal direction of said handle, and wherein said attaching means is accessible by way of one of said compartments, and wherein said attaching means comprises a pin having a head portion engageable with said one of said compartments and a shank extending therefrom externally of said housing and being sized and of a length to be inserted in said internal bore of said handle.

10. An insertion tool according to claim 9, wherein said housing further includes a generally cup-shaped portion of a size and shape for snugly surrounding and abutting against an end portion of said handle.

11. An insertion tool according to claim 10, further including a cap rotatably attached to an end portion of said housing opposite an end thereof by way of which said housing is attached to said handle by said attaching means, said cap, in the closed position, preventing access to said plurality of storage compartments and being pivotal to enable open access thereto.

12. An insertion tool according to claim 11, further comprising a spring clip having a first portion thereof affixed to said housing a second portion thereof displaceably abuttable against said housing and a third portion, located between said first and second portions, engaging said cap and providing pivoted movement therebetween and thereby pivotal attachment of said cap to said housing.

13. An insertion tool according to claim 9, wherein said impact force imparting mechanism is capable of imparting a selected one of a plurality of impact forces to a respective one of a plurality of types of tool blades storable in the plurality of storage compartments of said housing.

14. An insertion tool having a facility for storing a plurality of blades insertable into a connector receptacle by the operation of said tool comprising, in combination:

a handle;

a slide mounted in one end of said handle movable with respect thereto and yieldably urged toward an extended position therefrom, said slide including means for accepting a tool blade;

means, mounted in said handle, for imparting an impact force to said slide when said slide is forced inwardly from said extended position a predetermined distance;

a cylinder movable rotationally in said handle and having a bore therein in communication with an opening in the other end of said handle and including means for accepting a tool blade and releasably retaining it therein;

a housing having at least one closable compartment of a size and shape for storing therein a plurality of tool blades; and means, coupled with said housing, for attaching said housing to said tool by way of said accepting and retaining means of said handle.

15. An insertion tool according to claim 14, wherein said accepting and retaining means includes a coil spring in said bore having one end of the coil movable with said cylinder and having an inside diameter smaller than said bore which is adapted to engage said housing attachment means, whereby rotation of said cylinder is a direction opposite to the direction of spiral of said coil spring expands said inside diameter allowing insertion and removal of said housing attachment means.

16. An insertion tool according to claim 15, wherein said housing contains a plurality of compartments extending in parallel with one another in the direction of the longitudinal direction of said handle, and wherein said attaching means is accessible by way of one of said compartments, and wherein said attaching means comprises a pin having a head portion engageable with said one of said compartments and a shank extending therefrom externally of said housing and being sized and of a length to be internally engaged by said accepting and retaining means of said handle.

* * * * *

UNITED STATES PATENT AND TRADEMARK OFFICE

CERTIFICATE OF CORRECTION

PATENT NO. : 4,958,427

DATED : September 25, 1990

INVENTOR(S) : Terry L. Smith and William D. Krietzman

It is certified that error appears in the above-identified patent and that said Letters Patent is hereby corrected as shown below:

Column 5, line 31 (the fifth line of claim 9), at the beginning of the line before "an impact" insert --a handle having--.

Column 5, line 42 (line 16 of claim 9), before "said handle" insert the preposition --of--.

Signed and Sealed this

Twenty-second Day of March, 1994

Bruce Lehman

*Attest:*

BRUCE LEHMAN

*Attesting Officer*

*Commissioner of Patents and Trademarks*